US005796243A

United States Patent [19]

Kimura

[11] Patent Number: 5,796,243

[45] Date of Patent: Aug. 18, 1998

[54] CURRENT MULTIPLIER/DIVIDER CIRCUIT

[75] Inventor: Katsuji Kimura, Tokyo, Japan

[73] Assignee: NEC Corporation, Tokyo, Japan

[21] Appl. No.: 916,159

[22] Filed: Aug. 21, 1997

[30] Foreign Application Priority Data

Aug. 30, 1996 [JP] Japan ..... 8-248919

[51] Int. Cl.[6] ..... G05F 3/04

[52] U.S. Cl. ..... 323/312; 327/538

[58] Field of Search ..... 323/312, 319, 323/314, 315; 327/538

[56] References Cited

U.S. PATENT DOCUMENTS

| | | | |
|---|---|---|---|
| 4,045,694 | 8/1977 | Ahmed | 323/315 X |
| 4,284,945 | 8/1981 | Ahmed | 323/315 |
| 5,438,296 | 8/1995 | Kimura . | |
| 5,444,648 | 8/1995 | Kimura . | |
| 5,481,224 | 1/1996 | Kimura . | |
| 5,617,052 | 4/1997 | Kimura . | |
| 5,640,121 | 6/1997 | Kimura . | |

FOREIGN PATENT DOCUMENTS

| | | |
|---|---|---|
| 5-54158 | 3/1993 | Japan . |
| 2019066 | 10/1979 | United Kingdom . |

*Primary Examiner*—Peter S. Wong
*Assistant Examiner*—Y. J. Han
*Attorney, Agent, or Firm*—Sughrue, Mion, Zinn, Macpeak & Seas, PLLC

[57] ABSTRACT

A current multiplier/divider circuit is provided, which is capable of any one of multiplication and division operations in a current mode without changing its configuration. This circuit includes a first set of m bipolar transistors and a second set of n bipolar transistors, where m≧2) and n≧2. A base of a (j−1)-th one of the transistors of the first set is connected to an emitter of the j-th transistor of the first set, where 2≦j≦m. A base of a (k−1)-th one of the transistors of the second set is connected to an emitter of the k-th transistor of the second set, where 2≦k≦n. A sum of $V_{BE}$ of the m transistors with respect to a specific electric potential, which is generated at a base of the m-th transistor in the first set, is equal to a sum of $V_{BE}$ of the n transistors, which is generated at a base of the n-th transistor in the second set. At least one of collector currents of the (m+n) transistors in the first and second sets is used as an input current, at least one of these collector currents are used as an output current, and he remaining collector currents are set as constant currents, respectively. The at least one output current includes the multiplication or division result of the at least one input.

6 Claims, 6 Drawing Sheets

CURRENT MULTIPLIER/DIVIDER CIRCUIT

BACKGROUND OF THE INVENTION

1. Field of the Invention

The present invention relates to a multiplier/divider circuit operating in a current mode and more particularly, to a current multiplier/divider circuit for multiplying or dividing a plurality of input current signals, which is suitable for a bipolar semiconductor integrated circuit.

2. Description of the Prior Art

Conventionally, various multiplier and divider circuits operating in a voltage mode, i.e., "voltage multipliers" and "voltage dividers", have been already known. However, very few multiplier and divider circuits operating in a current mode, i.e., "current multipliers" and "current dividers", have been known.

For example, the Japanese Non-Examined Patent Publication No. 5-54158 published in 1993 discloses a multiplier circuit and a divider circuit each operating in a current mode. The current divider circuit disclosed in this Publication is shown in FIG. 1.

As shown in FIG. 1, this conventional current divider circuit is comprised of a current mirror subcircuit formed by npn-type bipolar transistors Q111 and Q112 and a differential subcircuit formed by emitter-coupled npn-type bipolar transistors Q113 and Q114. A collector and a base of the diode-connected transistor Q111 are connected to a node 113, and emitter thereof is connected to the ground. The base of the transistor Q111 is connected to a base of the mirror transistor Q112. A collector of the mirror transistor Q112 is applied with a supply voltage $V_{cc}$, and an emitter thereof is connected to a node 114.

A base of the transistor Q113 is connected to the emitter of the mirror transistor Q112. The coupled emitters of the transistors Q113 and Q114 are connected to one terminal of a constant current sink 111. The other terminal of the constant current sink 111 is applied with another supply voltage $V_{EE}$. The constant current sink 111 serves to drive the differential pair of the emitter-coupled transistors Q113 and Q114. A collector of the transistor Q113 is supplied with a current $I_{OUT}$. A collector of the transistor Q114 is connected to one terminal of a constant current source 112 supplying a constant bias current $I_{BIAS2}$. The other terminal of the constant current source 112 is applied with the supply voltage $V_{cc}$. A base of the transistor Q114 is connected to the ground.

A current $I_1$ flowing into the collector of the transistor Q111 and a current $I_2$ flowing out from the emitter of the transistor Q112 in the current mirror subcircuit serve as first and second input currents of this current divider circuit, respectively. The current $I_{OUT}$ flowing into the collector of the transistor Q113 in the differential subcircuit serves as an output current of this current divider circuit, which includes the division result of the first and second input currents $I_1$ and $I_2$.

The current $I_1$ is the sum of output currents $I_{ONL}$ to $I_{OPL}$ of multipliers 120. The summation of the output currents $I_{ONL}$ to $I_{OPL}$ is performed at the node 113, resulting in the input current $I_1$.

The second input current $I_2$ is the sum of input currents $I_{INNL}$ to $I_{INPL}$. The summation of the output currents $I_{INNL}$ and $I_{INPL}$ is performed at the node 114.

Additionally, although not illustrated here, the conventional current multiplication circuit disclosed in the Japanese Non-Examined Patent Publication No. 5-54158 has the same configuration (i.e., the combination of a current mirror subcircuit and a differential subcircuit) as that of the current division circuit shown in FIG. 1, except that the input currents and the bias current are different.

It is convenient if the multiplication and division of a plurality of input currents are available in analog signal application fields. In recent years, especially, such the signal processing as current-mode multiplication and division have been attracting the people's attention in these fields.

From this viewpoint, the above conventional current division circuit shown in FIG. 1 has the following problems.

First, if the conventional current division circuit shown in FIG. 1 is used as a current multiplication circuit, not only the input currents but also the bias currents need to be changed. In other words, the conventional current division circuit in FIG. 1 is different in configuration from the conventional current multiplication circuit.

Second, the current-mode multiplication or division operation for three or more inputs (e.g., a high-order arithmetic operation) is unable to be performed.

SUMMARY OF THE INVENTION

Accordingly, an object of the present invention is to provide a current multiplier/divider circuit capable of any one of multiplication and division operations in a current mode without changing its configuration.

Another object of the present invention is to provide current multiplier/divider circuit capable of any one of multiplication and division operations in a current mode for three inputs or more.

Still another object of the present invention is to provide current multiplier/divider circuit capable of any one of multiplication and division operations while keeping incidental errors to the multiplication or division operation at a low level.

The above objects together with others not specifically mentioned will become clear to those skilled in the art from the following description.

According to a first aspect of the present invention, a current multiplication/division circuit is provided, which includes a first set of first to m-th bipolar transistors and a second set of first to n-th bipolar transistors, where m is an integer equal to or greater than 2 and n is an integer equal to or greater than 2.

A base of the (j−1)-th transistor of the first set is connected to an emitter of the j-th transistor of the first set, where j is an integer ranging from 2 to m. A base of the (k−1)-th transistor of the second set is connected to an emitter of the k-th transistor of the second set, where k is an integer ranging from 2 to n.

A sum of base-to-emitter voltages of the first to m-th transistors of the first set with respect to a specific electric potential is generated at a base of the m-th transistor of the first set. A sum of base-to-emitter voltages of the first to n-th transistors of the second set with respect to the specific electric potential is generated at a base of the n-th transistor of the second set. The sum of the base-to-emitter voltages of the first to m-th transistors of the first set is equal to the sum of the base-to-emitter voltages of the first to n-th transistors of the second set.

At least one of collector currents of the first to m-th transistors of the first set and the first to n-th transistors of the second set is used as an input.

At least one of the collector currents of the first to m-th transistors of the first set and the first to n-th transistors of the second set other than the input are used as an output.

The at least one of the collector currents serving as the output includes the multiplication or division result of the at least one of the collector currents serving as the input.

With the current multiplication/division circuit according to the first aspect of the present invention, each of the second to m-th transistors of the first set is in the emitter follower configuration, and each of the second to n-th transistors of the second set is in the emitter follower configuration.

Further, the sum of the base-to-emitter voltages of the first to m-th transistors of the first set with respect to the specific electric potential, which is generated at the bas e of the m-th transistor of the first set, is equal to the sum of the base-to-emitter voltages of the first to n-th transistors of the second set with respect to the specific electric potential, which is generated at the base of the n-th transistor of the second set.

On the other hand, the collector current of each bipolar transistor in the first and second sets is proportional to the exponent of the ratio of the base-to-emitter voltage to the thermal voltage. In other words, the base-to-emitter voltage of each transistor is proportional to the logarithm of the ratio of the collector current to the saturation current.

Therefore, the sum of the base-to-emitter voltages of the first to m-th transistors in the first set is equal to the product of the collector currents thereof. Similarly, the sum of the base-to-emitter voltages of the first to n-th transistors in the second set is equal to the product of the collector currents thereof. Thus, the product of the collector currents of the first to m-th transistors of the first set is equal to the product of the collector currents of the first to n-th transistors of the second set.

As a result, if at least one of the collector currents of the first to m-th transistors of the first set and the first to n-th transistors of the second set is used as an input, at least one of the collector currents thereof is used as an output, and the remaining collector current or currents thereof are set to be constant as necessary, the multiplication or division result of the at least one input is obtained in the at least one output.

Because of the above reason, any one of multiplication and division operations is able to be performed in a current mode without changing its configuration by simply setting the values of the collector currents as the input and the output (and the constant current or currents, if necessary), respectively. This means that any one of multiplication and division operations in a current mode is able to be performed without changing the circuit configuration.

Also, the current-mode multiplication or division operation for three inputs or more can be performed by simply setting the values of the three collector currents or more as the inputs.

Moreover, since the current-mode multiplier or divider operation is carried out by utilizing the exponential law of a collector current of a bipolar transistor, the current-mode multiplication or division operation is performed while keeping incidental errors to the multiplication or division operation at a low level.

The number m of the transistors of the first set may be same as or different from the number n of the transistors of the second set.

In a preferred embodiment of the circuit according to the first aspect, the collector currents of the first to m-th transistors of the first set and the first to n-th transistors of the second set other than the input and the output are set to be constant, respectively.

In another preferred embodiment of the circuit according to the first aspect, each of the second to m-th transistors of the first set and the second to n-th transistors of the second set has a current source/sink with an emitter-follower configuration connected to an emitter of a corresponding one of the transistors of the first and second sets.

According to a second aspect of the present invention, another current multiplication/division circuit is provided, which includes a first set of first to m-th bipolar transistors and a second set of first to m-th bipolar transistors, where m is an integer equal to or greater than 2.

A base of the (j−1)-th transistor of the first set is connected to an emitter of the j-th transistor of the first set, where j is an integer ranging from 2 to m. A base of the (j−1)-th transistor of the second set is connected to an emitter of the j-th transistor of the second set. Emitters of the first transistors of the first and second sets are commonly connected to a first point with a first electric potential. Bases of the m-th transistors of the first and second sets are coupled together to be connected to a second point with a second electric potential.

At least one of collector currents of the first to m-th transistors of the first set and the first to m-th transistors of the second set are used as an input.

At least one of the collector currents of the first to m-th transistors of the first set and the first to m-th transistors of the second set other than the input are used as an output.

The at least one of the collector currents serving as the output includes the multiplication or division result of the at least one of the collector currents serving as the input.

With the current multiplication/division circuit according to the second aspect of the present invention, since the emitters of the first transistors of the first and second sets are commonly connected to the first point with the first electric potential, the base-to-emitter voltages of the first transistors of the first and second sets are equal. Also, each of the second to m-th transistors of the first set has an emitter follower configuration, and each of the second to m-th transistors of the second set has an emitter follower configuration.

Therefore, the base voltage of the m-th transistor of the first set with respect to the first electric potential is equal to a sum of the base-to-emitter voltages of the first to m-th transistors of the first set. Similarly, the base voltage of the m-th transistor of the second set with respect to the first electric potential is equal to a sum of the base-to-emitter voltages of the first to m-th transistors of the second set.

Because the base voltages of the m-th transistors of the first and second sets are equal to each other, the sum of the base-to-emitter voltages of the first-to m-th transistors of the first set is equal to the sum of the base-to-emitter voltages of the first to m-th transistors of the second set.

Accordingly, due to the same reason as that of the first aspect of the invention, there are the same advantages as those in the circuit according to the first aspect.

In a preferred embodiment of the circuit according to the second aspect, the collector currents of the first to m-th transistors of the first set and the first to m-th transistors of the second set other than the input and the output are set to be constant, respectively.

In another preferred embodiment of the circuit according to the second aspect, each of the second to m-th transistors of the first set and the second to m-th transistors of the second set has a current source/sink with an emitter-follower configuration connected to an emitter of a corresponding one of the transistors of the first and second sets.

BRIEF DESCRIPTION OF THE DRAWINGS

In order that the invention may be readily carried into effect, it will now be described with reference to the accompanying drawings.

DETAILED DESCRIPTION OF THE PREFERRED EMBODIMENTS

Preferred embodiments of the present invention will be described below with reference to the drawings attached.

FIRST EMBODIMENT

Figure 1:
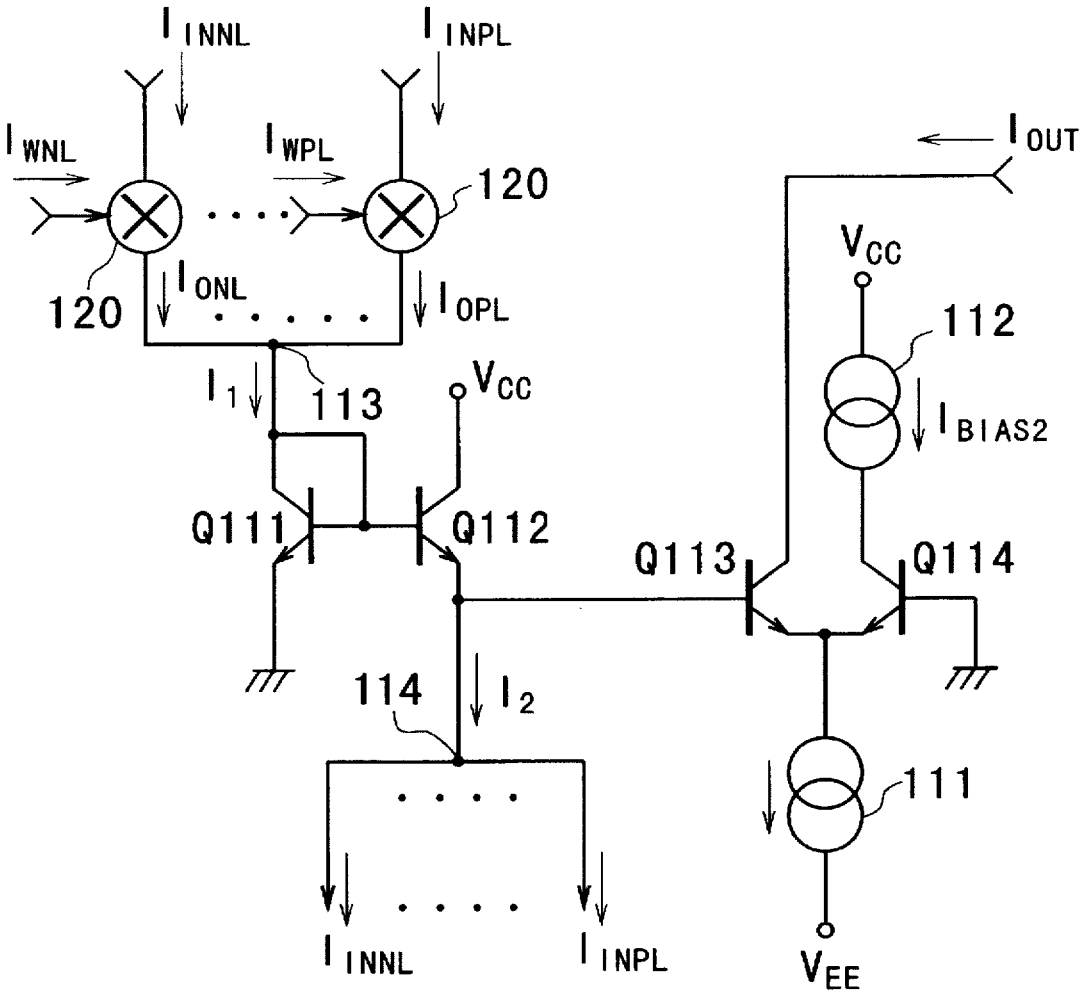
FIG. 1 PRIOR ART
FIG. 1 is a circuit diagram of a conventional current division circuit.
Figure 2:
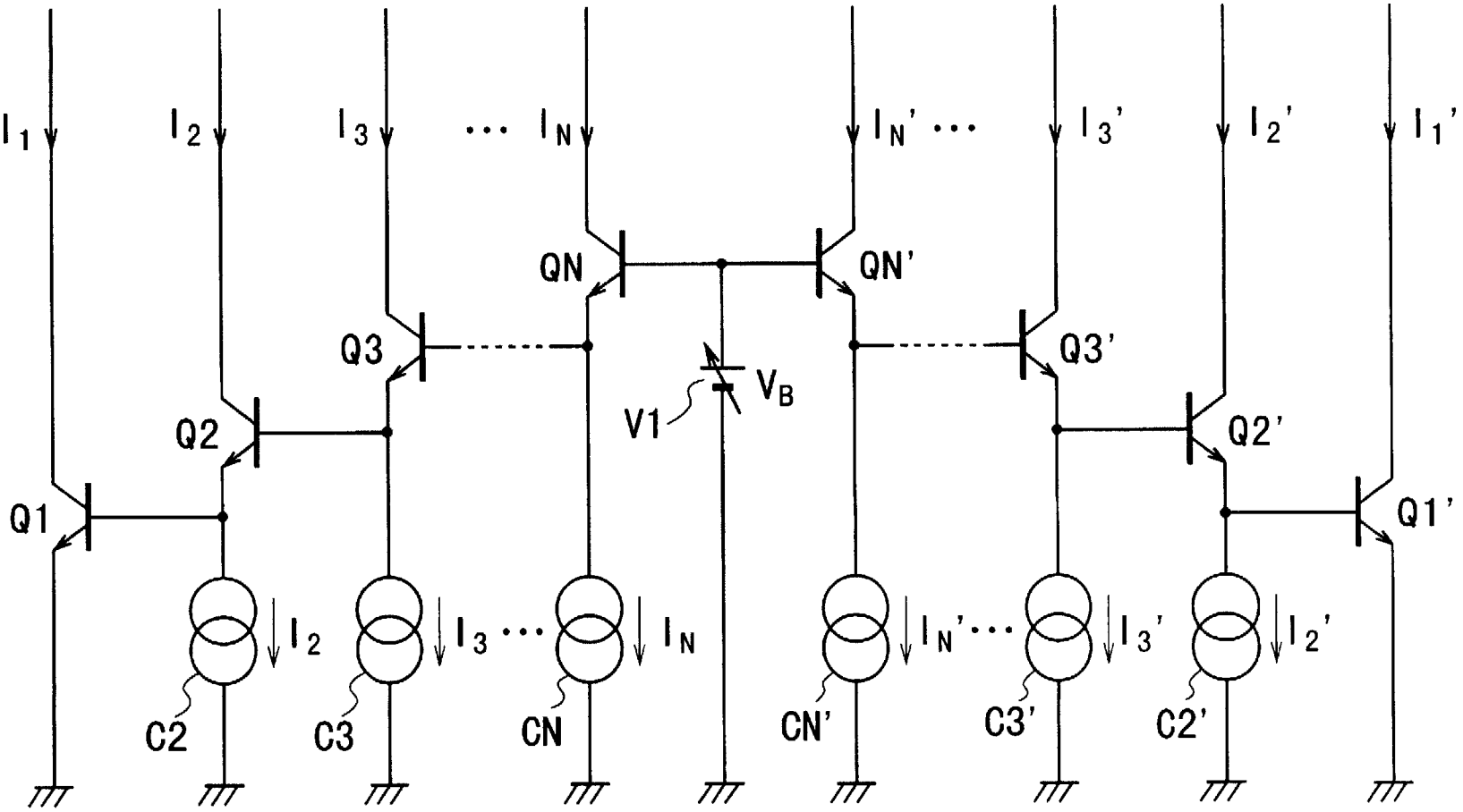
FIG. 2 is a circuit diagram of a current multiplication/division circuit according to a first embodiment of the invention, which shows the general configuration.

A current multiplier/divider circuit according to a first embodiment of the invention is shown in FIG. 2.

As shown in FIG. 2, this current multiplication/division circuit includes first to N-th npn-type bipolar transistors Q1, Q2, Q3 . . . QN of a first set and first to N-th npn-type bipolar transistors Q1', Q2', Q3', . . . QN' of a second set, where N is an integer equal to or greater than two (i.e., N≧2).

In the first transistor set, each of the second to N-th transistors Q2 to QN has the "emitter follower" configuration. Specifically, an emitter of the N-th transistor QN is connected to a base of the (N−1)-th transistor Q(N−1). Similarly, an emitter of the third transistor Q3 is connected to a base of the second transistor Q2, and an emitter of the second transistor Q2 is connected to a base of the first transistor Q1.

The emitter of the N-th transistor QN is further connected to a terminal of a variable current sink CN sinking a variable current $I_N$. The other terminal of the current sink CN is connected to the ground. Similarly, the emitter of the third transistor Q3 is further connected to a terminal of a variable current sink C3 sinking a variable current $I_3$. The other terminal of the current sink C3 is connected to the ground. The emitter of the second transistor Q2 is further connected to a terminal of a variable current sink C2 sinking a variable current $I_2$. The other terminal of the current sink C2 is connected to the ground.

An emitter of the first transistor Q1 is directly connected to the ground.

The second transistor set has the same emitter-follower configuration as that of the first transistor set. Specifically, an emitter of the N-th transistor QN' is connected to a base of the (N−1)-th transistor Q(N−1)'. Similarly, an emitter of the third transistor Q3' is connected to a base of the second transistor Q2', and an emitter of the second transistor Q2' is connected to a base of the first transistor Q1'.

The emitter of the N-th transistor QN' is further connected to a terminal of a variable current sink CN' sinking a variable current $I_N'$. The other terminal of the current sink CN' is connected to the ground. Similarly, the emitter of the third transistor Q3' is further connected to a terminal of a variable current sink C3' sinking a variable current $I_3$. The other terminal of the current sink C3' is connected to the ground. The emitter of the second transistor Q2' is further connected to a terminal of a variable current sink C2' sinking a variable current 12'. The other terminal of the current sink C2' is connected to the ground.

An emitter of the first transistor Q1' is directly connected to the ground.

A base of the N-th transistor QN of the first set and a base of the N-th transistor QN' of the second set are coupled together to be connected to a positive terminal of a variable voltage source V1 supplying a variable voltage $V_B$. A negative terminal of the voltage source 1 is connected to the ground.

Next, the operation principle of the current multiplication/division circuit according to the first embodiment in FIG. 2 is explained below.

In general, supposing that a collector current $I_1$ and a base-to-emitter voltage Vest of an i-th bipolar transistor satisfy the exponential law, the collector current $I_i$ is expressed by the following equation (1).

$$I_i = I_S \left\{ \exp\left[\frac{V_{BEi}}{V_T}\right] - 1 \right\} \tag{1}$$

In the equation (1), $I_s$ is the saturation current of the i-th transistor, and $V_T$ is the thermal voltage expressed as $V_T$=kT/q, where k is Boltzmann's constant, T is absolute temperature in degrees Kelvin and q is the charge of an electron.

When a bipolar transistor is in a normal operation where the base-to-emitter voltage $V_{BE}$, is approximately 600 mV, the exponential term "exp($V_{BEi}/V_T$)" has a value of approximately $e_{10}$. Therefore, the constant term "−1" may be ignored. As a result, the equation (1) can be rewritten to the following equation (2).

$$I_i = I_S \exp\left[\frac{V_{BEi}}{V_T}\right] \tag{2}$$

Here, if collector currents of the first to N-th transistors Q1 to QN and those of the first to N-th transistors Q1' to QN' are defined as $I_1$ to $I_N$ and $I_1'$ to $I_N'$, respectively, each of these collector currents can be expressed in the same form as shown by the equation (2).

Rewriting the equation (2) gives the following equation (3) that expresses the base-to-emitter voltage $V_{BEi}$.

$$V_{BEi} = V_T \ln\left[\frac{I_i}{I_S}\right] \tag{3}$$

Therefore, if the base-to-emitter voltages of the first to N-th transistors Q1 to QN and those of the first to N-th transistors Q1' to QN' are defined as $V_{BE1}$ to $V_{BEN}$ and $V_{BE1}'$ to $V_{BEN}'$, respectively, each of these base-to-emitter voltages can be expressed in the same form as shown by the equation (3).

Since the bases of the two transistors QN and QN' are commonly connected to be applied with the variable voltage $V_B$ supplied by the voltage source V1, the base voltages of these two transistors QN and QN' are equal to $V_B$ with respect to the ground. On the other hand, each of the second to N-th transistors Q2 to QN and Q2' to QN' of the first and second sets has the emitter-follower configuration and each of the first transistors Q1 and Q1' thereof has the emitter directly connected to the ground.

Therefore, the base voltage (i.e., $V_B$) of the N-th transistor QN of the first set is equal to the sum of the base-to-emitter voltages of the first to N-th transistors Q1 to QN thereof with respect to the ground. Similarly, the base voltage (i.e., $V_B$) of the N-th transistor QN' of the second set is equal to the sun of the base-to-emitter voltages of the first to N-th transistors Q1' to QN' thereof with respect to the ground.

Accordingly, the following equation (4) is established.

$$\sum_{i=1}^{N} V_{BEi} = \sum_{i=1}^{N'} V_{BEi}' = V_B \tag{4}$$

The left and middle sides of the equation (4) can be rewritten to the following equations (5) and (6) using the above equation (3), respectively.

$$\sum_{i=1}^{N} V_{BEi} = \sum_{i=1}^{N} \left\{ V_T \ln\left[\frac{I_i}{I_S}\right] \right\} = V_T \ln\left\{ \prod_{i=1}^{N} \left[\frac{I_i}{I_S}\right] \right\} \tag{5}$$

$$\sum_{i=1}^{N} V_{BEi}' = \sum_{i=1}^{N} \left\{ V_T \ln\left[\frac{I_i'}{I_S}\right] \right\} = V_T \ln\left\{ \prod_{i=1}^{N} \left[\frac{I_i'}{I_S}\right] \right\} \tag{6}$$

As a result, the following equation (7) is established from the equations (4), (5), and (6).

$$\prod_{i=1}^{N} I_i = \prod_{i=1}^{N} I_i' \tag{7}$$

It is seen from the equation (7) that the product of the collector currents $I_1$ to $I_N$ in the first set is equal to the product of the collector currents $I_1'$ to $I_N'$ in the second sets.

As described above, with the current multiplier/divider circuit according to the first embodiment in FIG. 2, if at least one of the collector currents $I_1$ to $I_N$ and $I_1'$ to $I_N'$ is set as an input current, at least one of the remaining collector currents $I_1$ to $I_N$ and $I_1'$ to $I_N'$ is set as an output current, and the remainder of the collector currents $I_1$ to $I_N$ and $I_1'$ to $I_N'$ is/are set as constant current or currents as necessary, any one of multiplication and division is able to be performed in a current mode.

Therefore, this circuit is capable of any one of multiplication and division in a current mode without changing the circuit configuration for three input currents or more.

Further, because the exponential law of a bipolar transistor is simply utilized, this circuit is capable of any one of multiplication and division while keeping incidental errors to arithmetic operation at a low level.

In this embodiment, the numbers of the transistors in the first set and that in the second set are equal. However, these numbers may be different from each other.

SECOND EMBODIMENT

Figure 3:
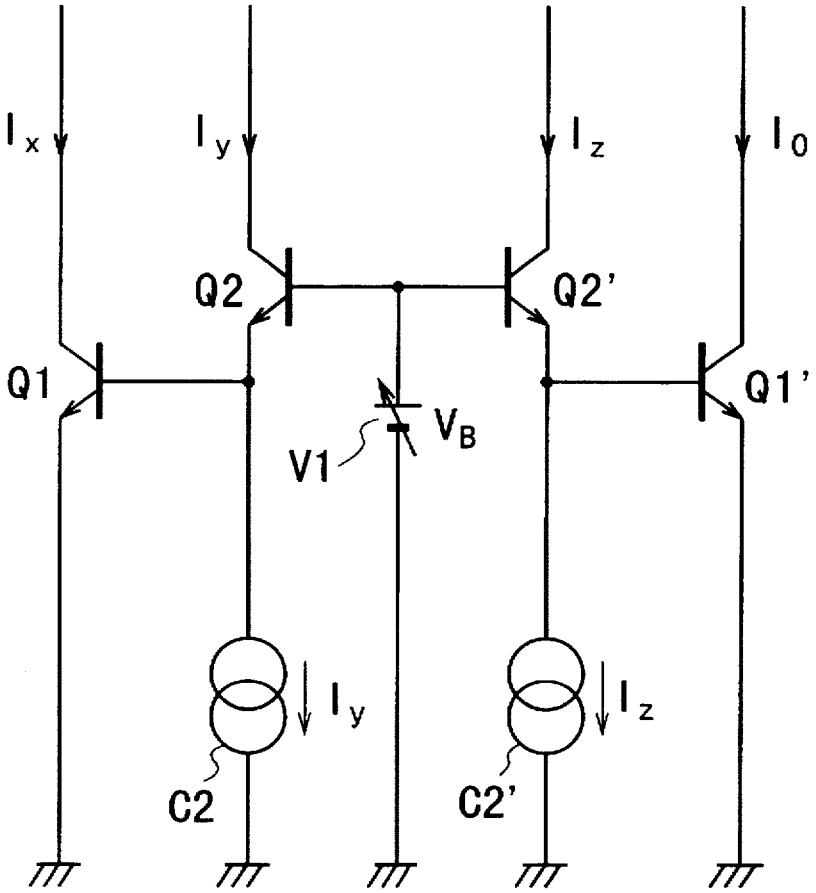
FIG. 3 is a circuit diagram of a current multiplication/division circuit according to a second embodiment of the invention, in which the multiplication operation of two input currents $I_x$ and $I_Y$ is performed.

FIG. 3 shows a current multiplier circuit according to a second embodiment of the invention. This circuit is obtained by setting the number N of the bipolar transistors as 2 (i.e., N=2) in the first embodiment in FIG. 2.

Further, the collector currents $I_1$ and $I_2$ of the first and second transistors Q1 and Q2 of the first set are designed as first and second variable currents $I_x$ and $I_y$, respectively. The collector currents $I_1'$ and $I_2$, of the first and second transistors Q1' and Q2' of the second set are designed as a constant current $I_0$ and a third variable current $I_z$, respectively.

The first variable current $I_x$ is supplied to the transistor Q1 by an external circuit (not shown). The second variable current $I_z$ is supplied to the transistor Q2 by the corresponding current sink C2. The third variable current $I_z$ is supplied to the transistor Q2' by the corresponding current sink C3. The constant current $I_0$ is supplied to the transistor Q1' by an external circuit (not shown).

In this second embodiment, since N=2, the above equation (7) is rewritten to the following equation (8).

$$I_1 \cdot I_2 = I_1' \cdot I_2. \tag{8}$$

Since $I_1=I_x$, $I_2=I_y$, $I_2'=I_z$, and $I_1'=I_0$, the following equation (9) is obtained from the equation (8).

$$I_z = \frac{I_x I_y}{I_0} \tag{9}$$

It is seen from the equation (9) that the circuit in FIG. 3 is capable of multiplication operation of the first and second variable currents $I_x$ and $I_y$ and that the third variable current $I_z$ represents the multiplication result of these two currents $I^x$ and $I_y$.

If the collector current $I_1'$ is designed as a fourth variable current instead of the constant current $I_0$, the fourth variable current represents the multiplication operation of the first, second, and third variable currents $I_x$, $I_y$, and $I_z$.

THIRD EMBODIMENT

Figure 4:
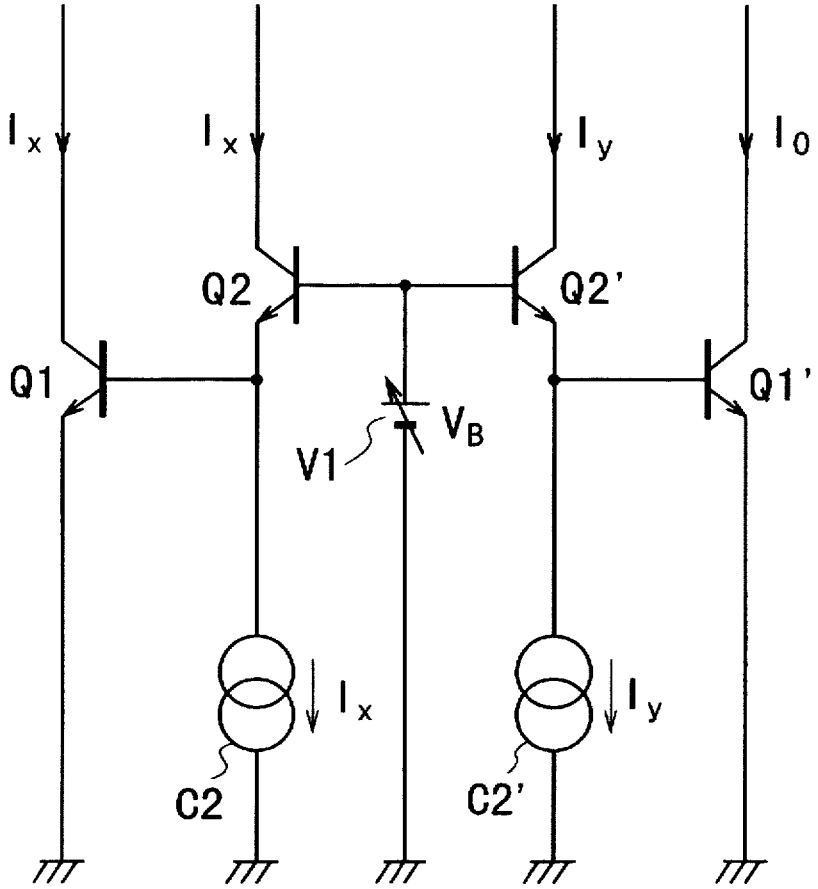
FIG. 4 is a circuit diagram of a current multiplication/division circuit according to a third embodiment of the invention, in which the squaring operation of an input current $I_x$ is performed.

FIG. 4 shows a current squaring circuit according to a third embodiment of-the invention. This circuit is obtained by setting the number of the bipolar transistors N as 2 (i.e., N=2) in the first embodiment in FIG. 2.

Further, the collector currents $I_1$ and $I_2$ of the first and second transistors Q1 and Q2 of the first set are designed as first and second variable currents $I_x$ with a same current value, respectively. The collector currents $I_1'$ and $I_2'$ of the first and second transistors Q1' and Q2' of the second set are designed as a constant current $I_0$ and a third variable current $I_y$, respectively.

The first variable current $I_x$ is supplied to the transistor Q1 by an external circuit (not shown). The second variable current $I_x$ is supplied to the transistor Q2 by the corresponding variable current sink C2. The second variable current $I_y$ is supplied to the transistor Q2' by the corresponding variable current sink C3. The constant current $I_0$ is supplied to the transistor Q1' by an external circuit (not shown).

In this third embodiment, since $I_1=I_2=I_x$, $I_{2'=Iy}$ and $I_1'=I_0$, the following equation (10) is obtained from the above equation (8).

$$I_z = \frac{I_x^2}{I_0} \tag{10}$$

It is seen from the equation (10) that the circuit in FIG. 4 is capable of squaring operation of the first (or, second) variable current $I_x$ and that the third variable current $I_y$ represents the cubing result of the variable current $I_x$.

If the collector current $I_2'$ is designed as a third variable current $I_x$ instead of the variable current $I_y$, and the collector current $I_1'$ is designed as a fourth variable current instead of the constant current $I_0$, the fourth variable current represents the cubing operation of the first, second, and third variable currents $I_1$, $I_y$, and $I_z$.

FOURTH EMBODIMENT

Figure 5:
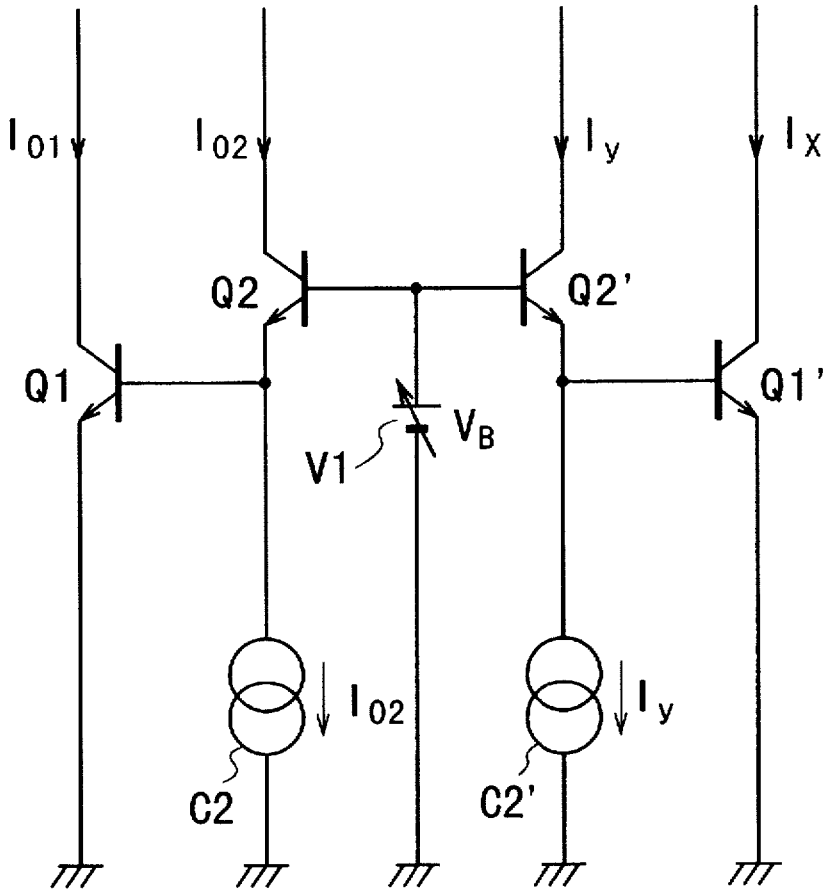
FIG. 5 is a circuit diagram of a current multiplication/division circuit according to a fourth embodiment of the invention, in which the division operation by an input current $I_x$ is performed.

FIG. 5 shows a current divider circuit according to a fourth embodiment of the invention. This circuit is obtained by setting the number of the bipolar transistors N as 2 (i.e., N=2) in the first embodiment in FIG. 2.

Further, the collector currents $I_1$ and $I_2$ of the first and second transistors Q1 and Q2 of the first set are designed as first and second constant currents $I_{01}$, and $I_{02}$, respectively. The collector currents $I_1'$ and $I_2'$ of the first and second transistors Q1' and Q2' of the second set are designed as first and second variable currents $I_x$ and $I_y$, respectively.

The first constant current $I_{01}$ is supplied to the transistor Q1 by an external circuit (not shown). The second constant current $I_{02}$ is supplied to the transistor Q2 by the corresponding constant current sink C2. The first variable current $I_x$ is supplied to the transistor Q1' by an external circuit (not shown). The second variable current $I_y$ is supplied to the transistor Q2' by the corresponding variable current sink C2'.

In this fourth embodiment, since $I_1'=I_x$, $I_2'=I_y$, $I_1=I_{01}$, and $I_2=I_{02}$, the following equation (11) is obtained from the equation (8).

$$I_y=\frac{I_{01}I_{02}}{I_x} \tag{11}$$

It is seen from the equation (11) that the circuit in FIG. 5 is capable of division operation of the constant product ($I_{01}\cdot I_{02}$) by the first variable current $I_y$ and that the second variable current $I_y$ represents the division result.

In this fourth embodiment also, similar variations as shown in the above second and third embodiments may be performed.

FIFTH EMBODIMENT

Figure 6:
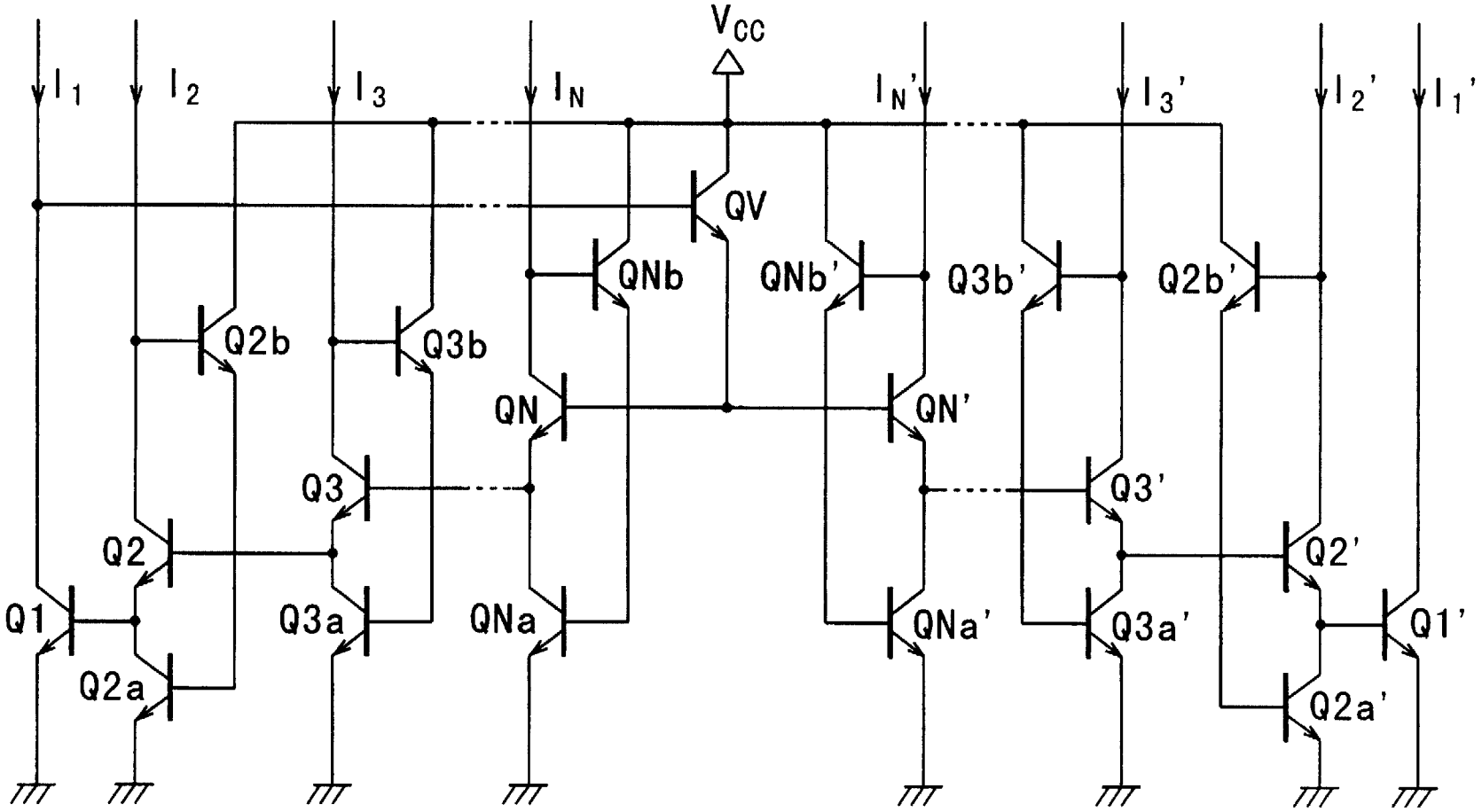
FIG. 6 is a circuit diagram of a current multiplication/division circuit according to a fifth embodiment of the invention, which includes the constant current sources/sinks with the emitter-follower configuration.

FIG. 6 shows a current multiplier circuit according to a fifth embodiment of the invention. This circuit has the same configuration as that of the first embodiment in FIG. 2 other than that each of the constant current sinks is formed by two bipolar transistors with the emitter-follower configuration. Therefore, the description about the same configuration is omitted here by adding the same reference numerals to the corresponding elements in FIG. 6 for the sake of simplification of description.

In this circuit, two npn-bipolar transistors Q2*a* and Q2*b* constitute the current sink C2 in FIG. 2, two npn-bipolar transistors Q3*a* and Q3*b* constitute the current sink C3 in FIG. 2, two npn-bipolar transistors QN*a* and QNb constitute the current sink CN in FIG. 2, two npn-bipolar transistors Q2*a*' and Q2*b*' constitute the current sink C2' in FIG. 2, two npn-bipolar transistors Q3*a*' and Q3*b*' constitute the current sink C3 in FIG. 2, and two npn-bipolar transistors QNa' and QNb' constitute the current sink CN' in FIG. 2.

Further, an npn-bipolar transistor QV constitutes the variable voltage source V1 in FIG. 2.

In FIG. 6, collectors of the transistors Q2*b*, Q3*b*, . . . , QN*b* of the first set, collectors of the transistors Q2*b*', Q3*b*', . . . , QNb' of the second set, and a collector of the transistor QV are coupled together to be applied with a power supply voltage $V_{cc}$. An emitter of the transistor QV is connected to the coupled bases of the transistors QN and. QN'. A base of the transistor QV is connected to the collector of the transistor Q1.

A collector of the transistor Q2*a* is connected to the emitter of the transistor Q2 and an emitter thereof is connected to the ground. A collector of the transistor Q3*a* is connected to the emitter of the transistor Q3 and an emitter thereof is connected to the ground. Similarly, a collector of the transistor QNa is connected to the emitter of the transistor QN and an emitter thereof is connected to the ground.

An emitter of the transistor Q2*b* is connected to a base of the transistor Q2*a*. An emitter of the transistor Q3*b* is connected to a base of the transistor Q3*a*. Similarly, an emitter of the transistor QNb is connected to a base of the transistor QNa.

A base of the transistor Q2*b* is connected to the collector of the corresponding transistor Q2. A base of the transistor Q3*b* is connected to the collector of the corresponding transistor Q3. similarly, a base of the transistor QNb is connected to the collector of the corresponding transistor QN.

A collector of the transistor Q2*a*' is connected to the emitter of the transistor Q2' and an emitter thereof is connected to the ground. A collector of the transistor Q3*a*' is connected to the emitter of the transistor Q3' and an emitter thereof is connected to the ground. Similarly, a collector of the transistor QNa' is connected to the emitter of the transistor QN' and an emitter thereof is connected to the ground.

An emitter of the transistor Q2*b*' is connected to a base of the transistor Q2*a*'. An emitter of the transistor Q3*b*' is connected to a base of the transistor Q3*a*'. Similarly, an emitter of the transistor QNb' is connected to a base of the transistor QNa'.

A base of the transistor Q2*b*' is connected to the collector of the corresponding transistor Q2'. A base of the transistor Q3*b*' is connected to the collector of the corresponding transistor Q3'. similarly, a base of the transistor QNb' is connected to the collector of the corresponding transistor QN'.

Each of the combinations of the transistors Q2*a* and Q2*b*, Q3*a*, and Q3*b*, . . . , QNa and QNb, and the combinations of the transistors Q2*a*' and Q2*b*', Q3*a*', and Q3*b*', . . . , and QNa' and QNb' constitutes a current sink with an emitter-follower configuration. For example, the transistor Q2*a* serves as a constant current sink and the corresponding transistor Q2*b* serves as an emitter-follower transistor.

Because of this configuration, there is an additional advantage that, for example, the current-sink operation of the current-sink transistor Q2*a* is difficult to be affected by the corresponding collector current $I_2$ due to the emitter-follower transistor Q2*b*.

In the above first to fifth embodiments, npn-type bipolar transistors are used. However, it is needless to say that pnp-type bipolar transistors may be used in the invention. Also, it is clear that any type of a constant current source/sink and any type of a voltage source may be used in the present invention.

The number of the transistors in the first set may be different from that of the transistors in the second set if the above equation (7) is established.

While the preferred form of the present invention has been described, it is to be understood that modifications will be apparent to those skilled in the art without departing from the spirit of the invention. The scope of the invention, therefore, is to be determined solely by the following claims.

What is claimed is:

1. A current multiplier or divider circuit comprising:

a first set of first to m-th bipolar transistors, where m is an integer equal to or greater than 2;

a second set of first to n-th bipolar transistors, where n is an integer equal to or greater than 2;

a base of (j−1)-th transistor of said first set being connected to an emitter of j-th transistor of said first set, where j is an integer ranging from 2 to m;

a base of (k−1)-th transistor of said second set being connected to an emitter of k-th transistor of said second set, where k is an integer ranging from 2 to n;

a sum of base-to-emitter voltages of said first to m-th transistors of said first set with respect to a specific electric potential being generated at a base of said m-th transistor of said first set;

a sum of base-to-emitter voltages of said first to n-th transistors of said second set with respect to said specific electric potential being generated at a base of said n-th transistor of said second set;

the sum of said base-to-emitter voltages of said first to m-th transistors of said first set being equal to the sum of said base-to-emitter voltages of said first to n-th transistors of said second set;

at least one of collector currents of said first to m-th transistors of said first set and said first to n-th transistors of said second set being used as an input;

at least one of said collector currents of said first to m-th transistors of said first set and said first to n-th transistors of said second set other than said input being used as an output;

said collector currents of said first to m-th transistors of said first set and said first to n-th transistors of said second set other than said input and said output being set to be constant, respectively; and said at least one of said collector currents serving as said output including the multiplication or division result of said at least one of said collector currents serving as said input.

2. A circuit as claimed in claim 1, wherein said collector currents of said first to m-th transistors of said first set and said first to n-th transistors of said second set other than said input and said output are set to be constant, respectively.

3. A circuit as claimed in claim 1, wherein each of said second to m-th transistors of said first set and said second to n-th transistors of said second set has a current source or sink with an emitter-follower configuration connected to an emitter of a corresponding one of said transistors of said first and second sets.

4. A current multiplication or division circuit comprising:

a first set of first to m-th bipolar transistors, where m is an integer equal to or greater than 2;

a second set of first to m-th bipolar transistors;

a base of (j−1)-th transistor of said first set being connected to an emitter of j-th transistor of said first set, where j is an integer ranging from 2 to m;

a base of (j−1)-th transistor of said second set being connected to an emitter of j-th transistor of said second set;

emitters of said first transistors of said first and second sets being commonly connected to a first point with a first electric potential;

bases of said m-th transistors of said first and second sets being coupled together to be connected to a second point with a second electric potential;

at least one of collector currents of said first to m-th transistors of said first set and said first to m-th transistors of said second set being used as an input;

at least one of said collector currents of said first to m-th transistors of said first set and said first to m-th transistors of said second set being used as an output;

said at least one of said collector currents serving as said output includes the multiplication or division result of said at least one of said collector currents serving as said input.

5. A circuit as claimed in claim 4, wherein said collector currents of said first to m-th transistors of said first set and said first to m-th transistors of said second set other than said input and said output are set to be constant, respectively.

6. A circuit as claimed in claim 4, wherein each of said second to m-th transistors of said first set and said second to m-th transistors of said second set has a current source or sink with an emitter-follower configuration connected to an emitter of a corresponding one of said transistors of said first and second sets.

* * * * *

UNITED STATES PATENT AND TRADEMARK OFFICE

CERTIFICATE OF CORRECTION

PATENT NO. : 5,796,243
DATED : August 18, 1998
INVENTOR(S) : Katsuji KIMURA

It is certified that error appears in the above-identified patent and that said Letters Patent is hereby corrected as shown below:

Column 1, line 64, delete "$I_{INPL}$" and insert -- $I_{INPL}$--.

Column 6, line 8, delete "12'" and insert -- $I_{2'}$--;

Column 6, line 22, delete "$I_1$" and insert -- $I_1$--;

Column 6, line 27 (eq. 1), delete "$I_i = I_S$" and insert -- $I_i = I_S$--;

Column 6, line 37, delete "$e_{10}$" and insert --$e^{10}$--;

Column 6, line 42 (eq. 2), delete "$I_i = I_S$" and insert -- $I_i = I_S$--;

Column 6, line 53 (eq. 3), "$\frac{I_i}{I_S}$" and insert --$\frac{I_i}{I_S}$--.

Column 7, line 7, delete "sun" and insert --sum--;

Column 7, line 20, delete both occurences of "$\frac{I_i}{I_S}$" and insert --$\frac{I_i}{I_S}$--;

Column 7, line 22, delete both occurences of "$\frac{I_i}{I_S}$" and insert --$\frac{I_i}{I_S}$--;

Column 7, line 28, delete "$I_i = \prod_{i=1}^{N} I_i$" and insert --$I_i = \prod_{i=1}^{N} I_i$--.

Column 8, line 9, delete "$I_1 \cdot I_2 = I_1$" and insert -- $I_1 \cdot I_2 = I_1$;

Column 8, line 10, delete "12'" and insert -- $I_{2'}$--;

UNITED STATES PATENT AND TRADEMARK OFFICE

CERTIFICATE OF CORRECTION

PATENT NO. : 5,796,243

DATED : August 18,1998

INVENTOR(S) : Katsuji KIMURA

It is certified that error appears in the above-identified patent and that said Letters Patent is hereby corrected as shown below:

Column 8, line 14, delete "equation (9) and insert -- $I_2 = \frac{I_x I_y}{I_0}$ --

Column 8, line 45, delete "1y" and insert --Iy--;

Column 8, line 50, delete equation (10) and insert -- $I_2 = \frac{I_x^2}{I_0}$ --;

Column 8, line 61, delete "$I_1$" and insert --$I_x$--.

Column 9, line 18, delete "equation (11)" and insert --$I_y \frac{I_{01} I_{02}}{I_x}$ --.

Signed and Sealed this

Sixth Day of June, 2000

*Attest:*

Q. TODD DICKINSON

*Attesting Officer*

*Director of Patents and Trademarks*